US007797932B2

(12) United States Patent
Herrick et al.

(10) Patent No.: US 7,797,932 B2
(45) Date of Patent: Sep. 21, 2010

(54) APPARATUS AND SYSTEM FOR ENHANCING AFTERTREATMENT REGENERATION

(75) Inventors: Brett Herrick, Columbus, IN (US); Stephen L. Mitchell, Columbus, IN (US)

(73) Assignee: Cummins, Inc, Columbus, IN (US)

( * ) Notice: Subject to any disclaimer, the term of this patent is extended or adjusted under 35 U.S.C. 154(b) by 707 days.

(21) Appl. No.: 11/742,305

(22) Filed: Apr. 30, 2007

(65) Prior Publication Data

US 2009/0064668 A1 Mar. 12, 2009

(51) Int. Cl.
*F01N 3/00* (2006.01)
*F01N 3/10* (2006.01)

(52) U.S. Cl. ..... 60/303; 60/286; 60/295

(58) Field of Classification Search ..... 60/280, 60/286, 295, 323, 324, 303
See application file for complete search history.

(56) References Cited

U.S. PATENT DOCUMENTS

| | | | | |
|---|---|---|---|---|
| 3,918,412 | A | 11/1975 | Lindstrom | |
| 4,834,043 | A * | 5/1989 | Kaczynski et al. | 123/297 |
| 5,915,626 | A | 6/1999 | Awarzamani et al. | 239/135 |
| 5,968,464 | A * | 10/1999 | Peter-Hoblyn et al. | 423/235 |
| 6,135,100 | A | 10/2000 | Katoh | 123/679 |
| 6,279,603 | B1 | 8/2001 | Czarnik et al. | 137/339 |
| 6,367,246 | B1 | 4/2002 | Hirota et al. | |
| 6,481,641 | B1 | 11/2002 | Mieney | 239/139 |
| 6,681,565 | B2 | 1/2004 | Russell | |
| 6,814,303 | B2 | 11/2004 | Edgar et al. | 239/128 |
| 6,925,802 | B2 | 8/2005 | Arnold et al. | |
| 6,968,831 | B2 * | 11/2005 | Kim et al. | 123/568.11 |
| 7,021,047 | B2 | 4/2006 | Hilden et al. | |
| 7,114,324 | B2 | 10/2006 | Hoard et al. | |
| 2004/0025499 | A1 | 2/2004 | Nakatani et al. | |
| 2008/0016850 | A1 * | 1/2008 | Shamis et al. | 60/286 |

OTHER PUBLICATIONS

PCT/US2008/062085 International Search Report and Written Opinion, Aug. 21, 2008.

* cited by examiner

*Primary Examiner*—Thomas E Denion
*Assistant Examiner*—Audrey Klasterka
(74) *Attorney, Agent, or Firm*—Kunzler Needham Massey & Thorpe

(57) ABSTRACT

An apparatus and system are disclosed for enhancing aftertreatment regeneration. The system includes an internal combustion engine and an exhaust manifold directing the engine exhaust to an aftertreatment system. The system may further include an exhaust gas recycle system and a turbocharger. The system further includes a fuel injector mounted on the exhaust manifold that provides fuel to assist in regenerating an aftertreatment component. The fuel injector is mounted in an apparatus also including a flow dampener, an extender, and a residence chamber. The apparatus allows the fuel to be injected in a high temperature location where it will experience residence time at temperature, and experience shear forces passing through the turbocharger. The extender allows the fuel to be injected at a place in the exhaust manifold where recycling of injected fuel into the engine is minimized.

30 Claims, 4 Drawing Sheets

APPARATUS AND SYSTEM FOR ENHANCING AFTERTREATMENT REGENERATION

BACKGROUND OF THE INVENTION

1. Field of the Invention

This invention relates to exhaust gas aftertreatment systems and more particularly to an apparatus and system for enhancing aftertreatment regeneration.

2. Description of the Related Art

Environmental concerns motivate emissions requirements for internal combustion engines throughout much of the world. Governmental agencies, such as the Environmental Protection Agency (EPA) in the United States, carefully monitor the emission quality of engines and set acceptable emission standards, to which all engines must comply. Generally, emission requirements vary according to engine type. Emission tests for compression-ignition (diesel) engines typically monitor the release of diesel particulate matter (PM), nitrogen oxides ($NO_x$), and unburned hydrocarbons (UHC).

The need to comply with emissions requirements encourages the development of exhaust gas aftertreatment systems. Aftertreatment systems frequently include one or more of a diesel oxidation catalyst (DOC), a $NO_x$ adsorption catalyst (NAC), and a diesel particulate filter (DPF). The DOC oxidizes unburned hydrocarbons in the exhaust stream for cleanup and/or temperature generation. The NAC adsorbs $NO_x$ from the exhaust gas and regenerates with periodic temperature events within the NAC. The DPF removes particulates from the exhaust gas stream. Furthermore, an exhaust gas recirculation (EGR) system may be implemented to reduce the formation of $NO_x$ during combustion.

Many aftertreatment components require temperature and/or UHC in the exhaust stream to facilitate regeneration, and many aftertreatment systems place a fuel injector (or "doser") in the exhaust stream to provide the temperature and/or UHC. The placement of the fuel injector is a challenge in aftertreatment system design. In one embodiment of the present technology, the fuel injector is placed downstream of an exhaust manifold and turbocharger. Placement of the fuel injector, a precise mechanical device with sensitive electronic components, downstream of the exhaust manifold helps to ensure that commercially reasonable fuel injectors requiring relatively low operating temperature environments may be utilized.

A common alternative method for dosing the exhaust gas is "in-cylinder dosing." The dosing fuel is injected directly into the combustion chamber ensuring that the fuel is thoroughly mixed with the exhaust before reaching the aftertreatment system. However, some of the challenges of in-cylinder dosing include diluting the engine oil with fuel, fuel recycling through the EGR, and the necessity of including a post-injection capable fuel system that may be more expensive than desired (e.g. a common rail fuel system).

Even if the fuel injector temperature limitations are overcome—perhaps through exotic materials and expensive cooling packages—placing the fuel injector into the exhaust manifold, or injecting in-cylinder, is difficult on engines with EGR. Fuel injected can be recirculated through the EGR path, potentially fouling an EGR cooler and EGR valve, and disrupting the designed torque and operation of the engine. Some engines may include grid heaters or other components in the air intake that are exposed to EGR flow and should not be exposed to unburned fuel. In the current technology, placing of a fuel injector in the exhaust manifold or dosing in-cylinder typically involves shutting off EGR and/or bypassing the EGR cooler. This results in increased emissions and/or lower power density of the engine.

Placement of the aftertreatment fuel injector downstream of the turbocharger presently causes performance limitations on the aftertreatment system. The placement downstream of the turbocharger means the fuel is injected into a cooler, low shear and low turbulence environment, closer to the component of interest—usually the DOC—and therefore the fuel may not be completely evaporated and distributed in the exhaust stream. Also, in the environment downstream of the turbocharger, the fuel does not experience enough time at temperature to begin breaking down from large hydrocarbon chains to small hydrocarbon chains, further reducing the oxidizing effectiveness of the DOC or other aftertreatment component.

An alternate placement of the aftertreatment fuel injector upstream of the turbocharger may allow for more flexibility of engine and aftertreatment design and permit fuel in the exhaust stream to experience higher temperatures, more turbulence, more shear forces, and longer residence time leading to superior oxidation and superior performance of the aftertreatment system.

SUMMARY OF THE INVENTION

From the foregoing discussion, applicant asserts that a need exists for a system and apparatus to enhance aftertreatment regeneration. Beneficially, such a system and apparatus would allow placement of a fuel injector within an exhaust manifold providing a higher temperature environment, with greater turbulence and shear causing better mixing of injected fuel and exhaust gas. In a further beneficial improvement, the system and apparatus would allow for the continued normal use of EGR, while injecting fuel, compared to in-cylinder dosing. Additionally, the system and apparatus would provide a longer residence time for injected fuel compared to present methods of downstream dosing.

The present invention has been developed in response to the present state of the art, and in particular, in response to the problems and needs in the art that have not yet been fully solved by currently available aftertreatment fuel injection systems and apparatus. Accordingly, the present invention has been developed to provide a system and apparatus for placing a fuel injector within a region of an exhaust manifold that overcome many or all of the above-discussed shortcomings in the art.

An apparatus is disclosed to enhance aftertreatment regeneration. The apparatus includes a flow dampener comprising an orifice. The flow dampener may further include a wall segment comprising a frustum of a defining cone. The apparatus includes an extender coupled to the flow dampener configured to dispose the orifice within a normal flow region of an exhaust manifold. The normal flow region comprises a region of the exhaust manifold where an exhaust flow from an engine experiences minimal flow reversal. The extender may comprise a portion of the wall segment. The apparatus further includes a residence chamber disposed within the extender and the flow dampener, and a fuel injector configured to inject fuel into the residence chamber. In one embodiment, the apparatus includes an insulator ring placed between the fuel injector and the residence chamber.

The apparatus may include the extender configured such that the injected fuel enters an exhaust stream in a location where minimal exhaust gas recycles to the engine intake. In one embodiment of the apparatus, the residence chamber has a volume such that the injected fuel fully vaporizes before diffusing through the orifice. The apparatus may include a flow dampener configured to dampen an exhaust flow convection through the orifice into the residence chamber such that the fuel injector maintains a temperature below a threshold temperature.

A system is disclosed to enhance aftertreatment regeneration. The system comprises an internal combustion engine producing an exhaust stream and an exhaust manifold coupled to the engine to receive the exhaust stream. The system further comprises the apparatus coupled to the exhaust manifold and configured to inject fuel into the exhaust stream. The system may further comprise a turbocharger including a turbine inlet port receiving the exhaust stream from the exhaust manifold.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

It will be readily understood that the components of the present invention, as generally described and illustrated in the figures herein, may be arranged and designed in a wide variety of different configurations. Thus, the following more detailed description of the embodiments of the apparatus and system of the present invention, as presented in FIGS. 1 through 4, is not intended to limit the scope of the invention, as claimed, but is merely representative of selected embodiments of the invention.

Reference throughout this specification to "one embodiment" or "an embodiment" means that a particular feature, structure, or characteristic described in connection with the embodiment is included in at least one embodiment of the present invention. Thus, appearances of the phrases "in one embodiment" or "in an embodiment" in various places throughout this specification are not necessarily all referring to the same embodiment.

Furthermore, the described features, structures, or characteristics may be combined in any suitable manner in one or more embodiments. In the following description, numerous specific details are provided, such as examples of materials, fasteners, sizes, lengths, widths, shapes, etc., to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

Figure 1:
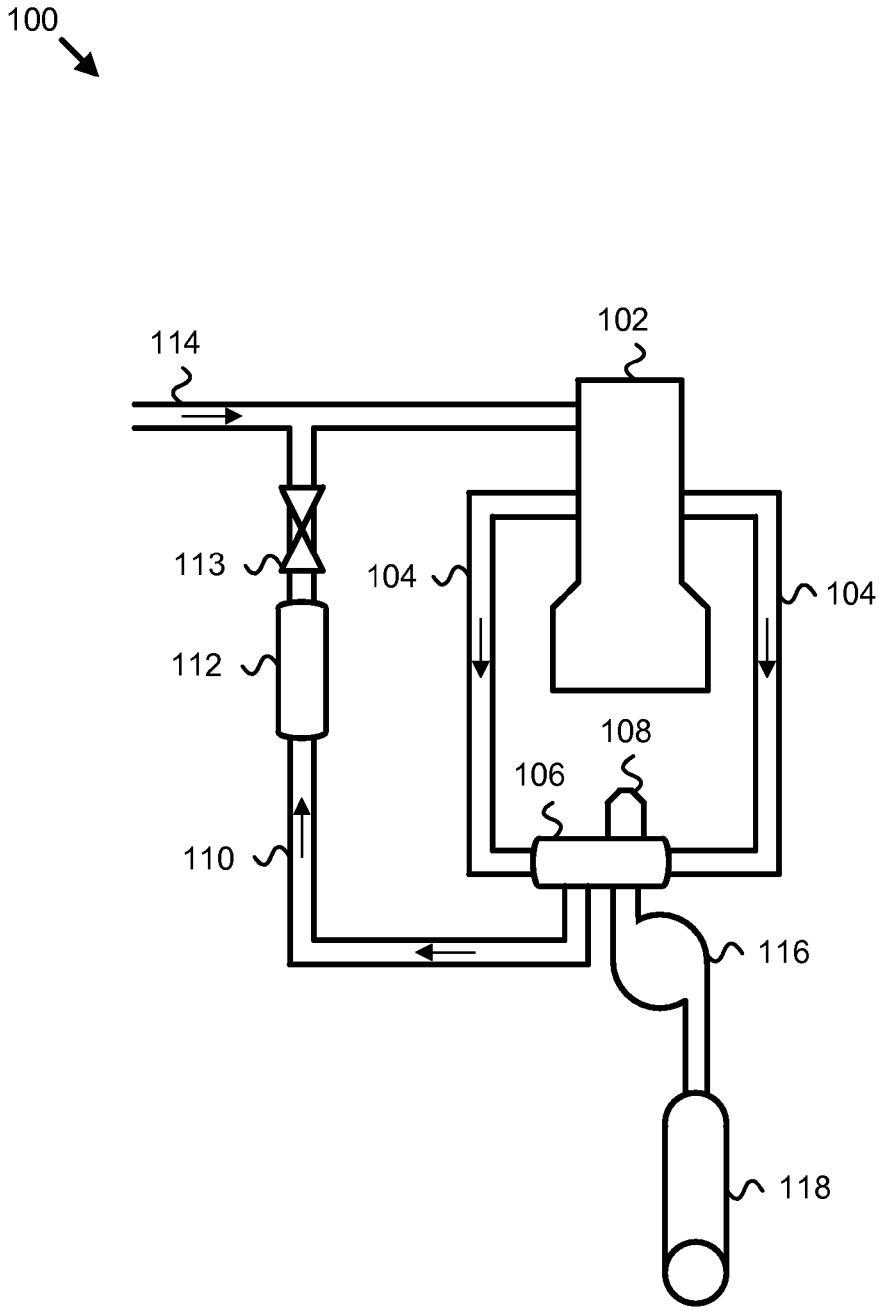
FIG. 1 is an illustration depicting one embodiment of a system to enhance aftertreatment regeneration in accordance with the present invention.

FIG. 1 is an illustration depicting one embodiment of a system 100 to enhance aftertreatment regeneration in accordance with the present invention. The system 100 comprises an internal combustion engine 102 producing an exhaust stream 104. The internal combustion engine 102 may be any type of internal combustion engine 102. In one embodiment, the internal combustion engine 102 is a diesel engine 102. The system 100 further comprises an exhaust manifold 106 coupled to the engine 102. The exhaust manifold 106 is configured to receive the exhaust stream 104 coming from the engine 102. The exhaust stream 104 may be from one exhaust bank, two exhaust banks, a plurality of exhaust banks, dual exhaust pipes with dual aftertreatment systems, and/or any other configuration of exhaust streams 104 coming from the combustion engine 102. For example, a six-cylinder diesel engine 102 produces six exhaust streams 104 that collect in a pipe 106 configured as the exhaust manifold 106. The exhaust manifold 106 is any apparatus configured to receive the exhaust stream 104 or exhaust streams 104 from the engine 102.

The system 100 further comprises a doser assembly 108. The doser assembly 108 further comprises a flow dampener that is configured to reduce the heat transfer via convection from the exhaust stream 104 to the fuel injector. The flow dampener includes an orifice that restricts the flow of exhaust gas into the area around the fuel injector. In one example, the flow dampener is configured within a doser assembly 108 to support a fuel injector that is configured to function at 400 degrees F. in an exhaust manifold 106 experiencing standard diesel exhaust temperatures of about 1400 degrees F.

The doser assembly 108 of the system 100, in one embodiment, further comprises an extender coupled to the flow dampener. The extender disposes the orifice of the flow dampener into a normal flow region of the exhaust manifold 106. The normal flow region may be a region of the exhaust manifold 106 where the exhaust flow 104 recirculating through to the exhaust gas recirculation (EGR) path 110 is minimal under normal operating conditions. For example, the normal flow region may be a region close to a turbine inlet port. In one embodiment, the normal flow region is within about three inches from a turbine inlet port. In an alternate embodiment, the normal flow region may be beyond an outlet of the exhaust manifold 106. The extender may be configured such that the injected fuel enters the exhaust stream in a location where minimal exhaust gas recycles to the engine intake.

The doser assembly 108 further comprises a residence chamber that is a volume disposed within the extender and the flow dampener. The residence chamber may have a volume such that the injected fuel experiences a sufficient residence time within the residence chamber such that the injected fuel fully vaporizes before diffusing through the orifice. For example, if simple testing indicates that liquid hydrocarbon is diffusing from the residence chamber, the residence chamber volume may be increased and/or the orifice size may be decreased to make the residence chamber volume sufficient to provide the residence time to vaporize the injected hydrocarbons. The doser assembly 108 may include an insulating ring interposed between the fuel injector and the residence chamber.

The doser assembly 108 further comprises a fuel injector configured to inject fuel into the residence chamber. The fuel is injected to add energy to the exhaust flow and may be a hydrocarbon, hydrogen, alcohol, and/or other fuel, and may be the same fuel used by the combustion engine 102. The fuel diffuses from the residence chamber through the flow dampener into the exhaust stream as exhaust gas pulses intermittently in and out of the flow dampener.

The system 100 further comprises an EGR path 110 configured to recirculate a portion of the exhaust flow 104. The EGR path 110 may include an EGR cooler 112 that cools the exhaust gas before the exhaust gas combines with an engine inlet air stream 114. The EGR path 110 may further include an EGR valve 113 that restricts and allows EGR flow. The EGR valve 113 may be upstream or downstream of an EGR cooler 112. The system 100 may further comprise a turbocharger 116 configured to receive an exhaust flow from the exhaust manifold 106. The turbocharger 116 may be more than one turbocharger 118 configured in parallel or in series. The turbocharger 118 may be a standard turbocharger, a wastegate turbocharger, and/or a turbocharger with variable geometry (VGT).

The system 100 further comprises an aftertreatment device 118 configured to treat an exhaust gas. The aftertreatment device 118 may be multiple devices configured to support each other, and/or be configured to treat multiple exhaust gas components. In a first example, the aftertreatment device 118 may burn a hydrocarbon to heat another aftertreatment device 118. In a second example, a first aftertreatment device 118 may be a diesel oxidation catalyst (DOC), a second aftertreatment device 118 may be a $NO_x$ adsorption catalyst (NAC), and a third aftertreatment device 118 may be a particulate filter. In the second example, at one operating point, the fuel injector injects diesel fuel into the exhaust gas, the DOC burns the diesel fuel upstream of the NAC, the heat generated by the DOC facilitates a regeneration event within the NAC, and a particulate filter removes particulates from the exhaust gas.

Figure 2A:
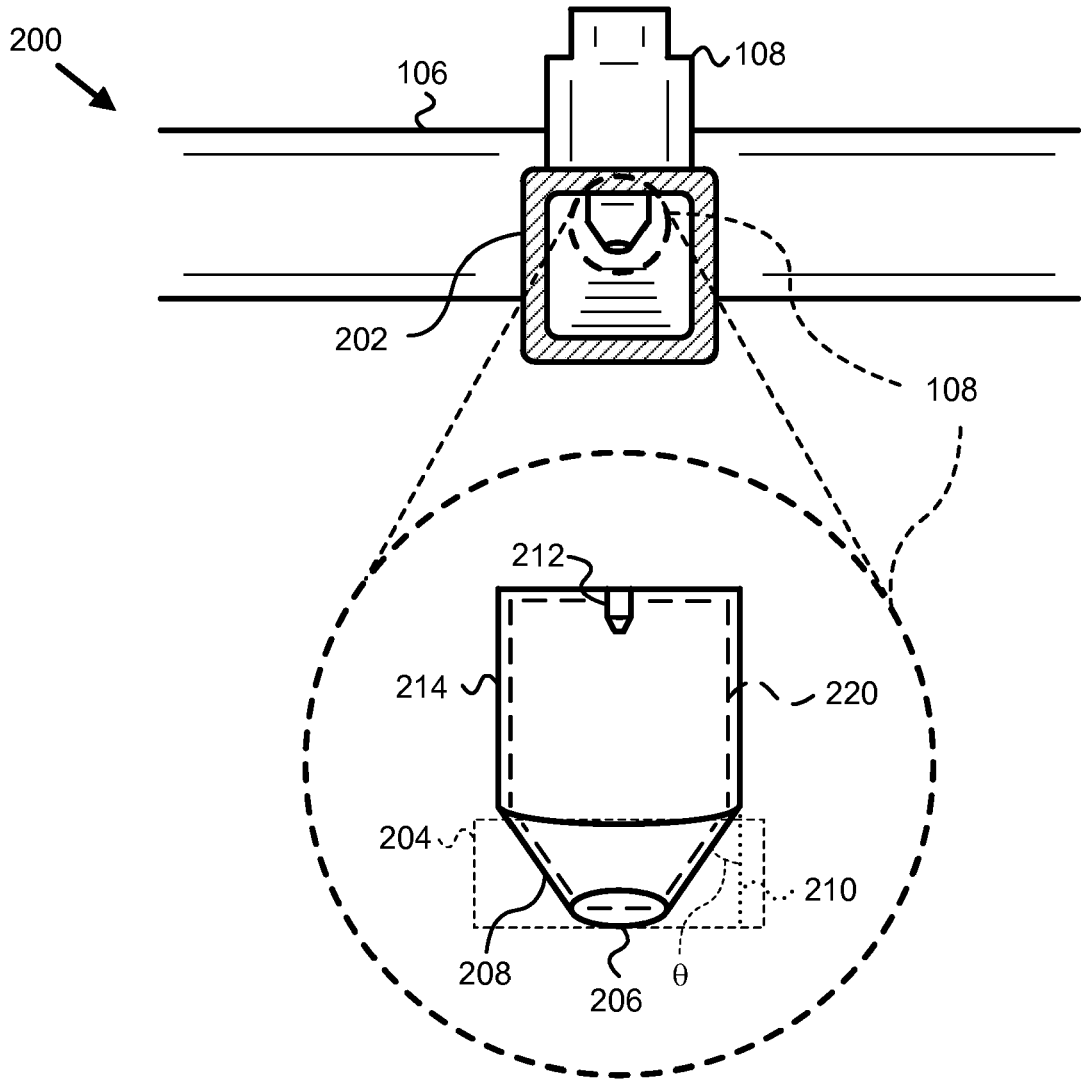
FIG. 2A is an illustration depicting one embodiment of an apparatus to enhance aftertreatment regeneration in accordance with the present invention.

FIG. 2A is an illustration depicting one embodiment of an apparatus 200 to enhance aftertreatment regeneration in accordance with the present invention. The apparatus 200 comprises the doser assembly 108 coupled to the exhaust manifold 106 near a turbocharger interface 202. The doser assembly 108 includes a flow dampener 204 comprising an orifice 206 that may, in one embodiment, comprise a diameter of about 10 mm. The flow dampener 204 may comprise only the orifice 206. In alternate embodiments, the flow dampener 206 further includes a wall segment 208 comprising a frustum of a defining cone. The defining cone is illustrated as a right-angle cone in FIG. 2A, and the orifice 206 is shown intersecting the cone at a right angle, but these can be any angle to meet the geometry of the system 100. The orifice 106 angle, in one embodiment, is as close to a right angle with the cone as the system 100 geometry allows.

The flow dampener 204 of the apparatus 200 is configured to provide a low heat transfer environment—especially a low convection environment—around a fuel injector 212 according to the expected temperatures and expected exhaust flow 104 conditions (e.g. peak rates, average rates, Reynolds number, etc.) within the exhaust manifold 106. In one embodiment, the exhaust flow 104 through the exhaust manifold 106 may be turbulent and an angle θ of not more than 30 degrees is sufficient to maintain an operational temperature range of the fuel injector 212. In an alternate embodiment, where the exhaust manifold 106 experiences a high steady-state exhaust flow 104, an angle θ of not more than about 45 degrees is sufficient to maintain the operational temperature range of the fuel injector 212.

In one embodiment, the flow dampener is configured to dampen an exhaust flow convection through the orifice into the residence chamber 220, such that the fuel injector 212 maintains a temperature below a threshold temperature. It is a mechanical step for one of skill in the art to determine a flow dampener 204 configuration, defined by an orifice 206 size and angle θ, to achieve a required heat transfer environment for a fuel injector 212 in a given embodiment of the system 100 based on the exhaust flow 104 temperature and conditions, the temperature requirements for the fuel injector 212, and the disclosures herein.

The doser assembly 108 further includes an extender 214 coupled to the flow dampener 204 configured to dispose the orifice 206 within a normal flow region 216 (refer to FIG. 2B) of the exhaust manifold 106. The normal flow region 216 may be a region of the exhaust manifold 106 where the exhaust flow 104 from the engine 102 experiences minimal flow reversal. During ordinary engine 102 operation, different cylinders fire intermittently, causing pressure pulses within the exhaust manifold 106. Some regions of the exhaust manifold 106 thereby experience significant reversals in the flow direction, and the regions experiencing such reversals for a given system 100 are ordinarily understood by one of skill in the art familiar with the particular system 100.

In one embodiment, the normal flow region 216 is the region 216 downstream of a plurality of cylinder exhausts. For example, a point in the exhaust manifold that is downstream of every cylinder exhaust will ordinarily experience minimal flow reversal, even though pulses in the flow magnitude will occur. In one embodiment, the normal flow region 216 is a region within about 3 inches of a turbine inlet port 218 (refer to FIG. 2B). The normal flow region 216 should be selected such that fuel injected into the normal flow region 216 does not significantly recirculate through the EGR path 110. A simple check of whether unburned hydrocarbons are recirculating through the EGR path 110 will confirm whether the normal flow region 216 is selected such that minimum flow reversal is occurring.

In one embodiment, the wall segment 208 of the doser assembly 108 includes a portion of the wall segment 208 comprising a part of the flow dampener 204 and a portion of the wall segment 208 comprising a part of the extender 214. The length and diameter of the extender 214 are functions of the exhaust manifold 106 geometry, fuel injector 212 size, a required residence chamber 220 volume, location of the normal flow area 216, mounting position of the doser assembly 108, and other application specific parameters. It is a mechanical step by one of skill in the art to determine the length and diameter of the extender 214 based on the physical layout of a given system 100 and the disclosures herein. The extender 214 length and diameter should be selected such that the orifice 206 is within the normal flow region 216, and that sufficient residence chamber 220 volume (discussed below) is available. In one embodiment, the extender 214 length is at least about 1.6 inches. In an alternate embodiment, the extender 214 length is about 40 mm, the extender diameter is about 35 mm, a flow dampener height 210 is about 20 mm, and the orifice 206 diameter is about 10 mm. In an embodiment where the normal flow region is accessible to a doser assembly 108 mounting location, the extender 214 length may be zero.

The doser assembly 108 of the apparatus 200 further comprises the fuel injector 212 configured to inject fuel into the residence chamber 220. The fuel injector 212 shown in FIG. 2A extends slightly into the residence chamber 220 to clearly illustrate the approximate placement of the injector 212. The fuel injector 212 may also not extend into the residence chamber 220, and may be recessed from the residence chamber 220 in some embodiments.

The maximum fuel injection rate of the fuel injector 212 depends on the requirements of the aftertreatment system, the selected regeneration strategies for the aftertreatment system, and the thermal delivery capabilities and fuel system of the engine 102. The maximum fuel injection rate for a given system 100 is ordinarily understood by one of skill in the art familiar with the particular system 100. In one embodiment, for an approximately 6-Liter displacement engine 102 with a DOC, NAC, and particulate filter, the maximum fuel injection rate is about 60 $cm^3$/minute. The maximum fuel injection rate may represent the maximum fuel injection rate the fuel injector is capable of injecting, and/or the maximum fuel injection rate expected by the design requirements of the aftertreatment device(s) 118. For example, a fuel injector 212 may be capable of injecting 150 $cm^3$/minute, but the aftertreatment device 118 required temperature and engine capabilities 102 may indicate a maximum fuel injection rate of 100 $cm^3$/minute.

The doser assembly 108, in one embodiment, further includes the residence chamber 220 disposed within both the extender 214 and the flow dampener 204. The fuel injector 212 injects fuel into the residence chamber 220, where the fuel mixes into the gas of the residence chamber 220 and diffuses through the orifice 206 into the exhaust flow 104. In one embodiment, the residence chamber 220 volume is sized to provide sufficient time for injected fuel to evaporate and break down before diffusion into the exhaust flow 104. The required residence time depends on the fuel composition, the temperature in the residence chamber 220 at operating conditions, the catalyst composition of an aftertreatment device 118 oxidizing the fuel, and other parameters specific to a given embodiment of the system 100. The available residence time depends on the maximum fuel injection rate, the volume of the residence chamber 220, the size of the orifice 206, and the exhaust flow 104 conditions in the normal flow area 216. In one embodiment, the injected fuel is not completely vaporized within the residence chamber, but is entrained and well-mixed in the gas phase, and by passing through the mixing in the turbocharger 116 the injected fuel completes the vaporization process.

One of ordinary skill in the art may determine the appropriate volume of the residence chamber 220 through simple experimentation. Specifically, if the system 100 exhibits unburned hydrocarbons at the outlet (e.g. the turbocharger outlet 116, and/or the exhaust system outlet) at operating conditions and required fuel injection rates with a properly sized catalyst element in the aftertreatment device 118, the residence chamber 220 size should be increased. In one embodiment, the volume of the residence chamber 220 comprises a volume of at least $0.5*V_1$, where $V_1$ is an expected fuel injection volume per minute. For example, the expected fuel injection volume per minute ($V_1$) for a system 100 is 60 $cm^3$/minute and the volume of the residence chamber is at least 30 $cm^3$ (1.8 $in^3$).

In one embodiment, a displacement volume $V_{eng}$ of the engine 102 and a volume $V_{rc}$ of the residence chamber 220 comprise a ratio $V_{eng}/V_{rc}$ of less than about 200. For example, the displacement volume $V_{eng}$ for a system is 6,700 $cm^3$ (409 $in^3$) and the residence chamber volume $V_{rc}$ is greater than about 33.5 $cm^3$ (2.0 $in^3$). In an alternate embodiment, the residence chamber 220 comprises a volume of about 35,000 $mm^3$.

Figure 2B:
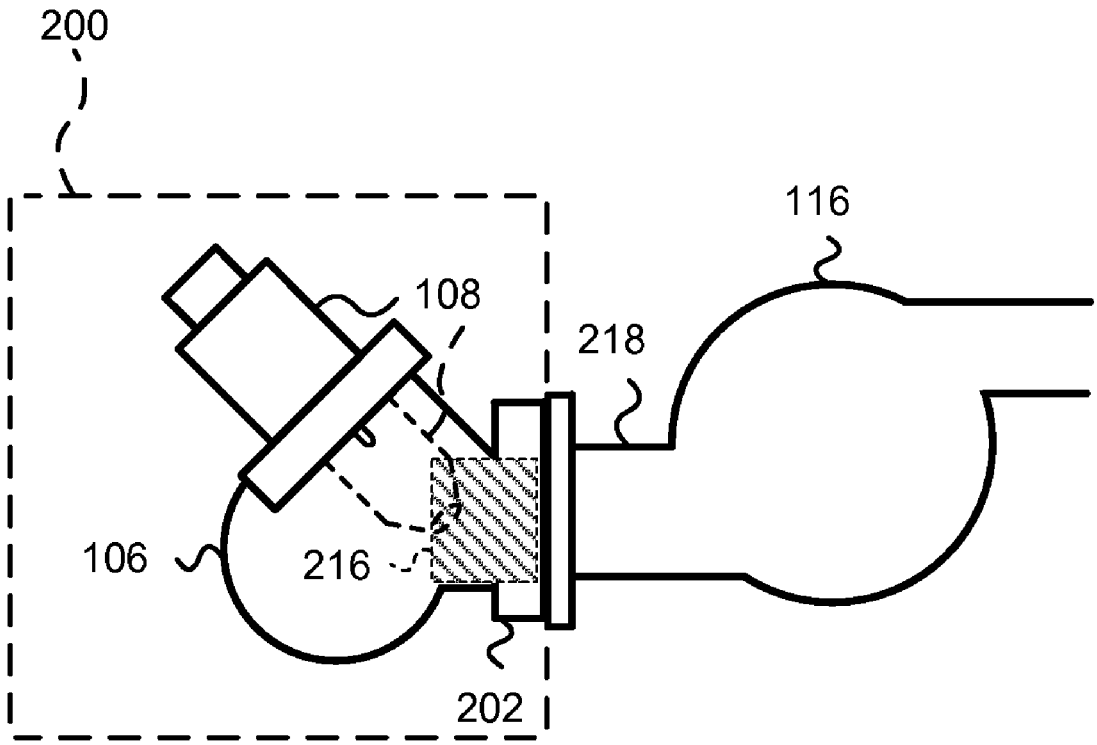
FIG. 2B is an illustration depicting a side view of one embodiment of an apparatus to enhance aftertreatment regeneration in accordance with the present invention.

FIG. 2B is an illustration depicting a side view of one embodiment of an apparatus 200 to enhance aftertreatment regeneration in accordance with the present invention. The side view of the apparatus 200 is shown to enhance understanding of the positioning of the doser assembly 108 in relation to the exhaust manifold 106 and the turbocharger 116 for the embodiment of FIG. 2A. The doser assembly 108 is coupled to the exhaust manifold 106 with the orifice 206 (not marked in FIG. 2B to avoid cluttering the Figure) within the normal flow region 216 of the exhaust manifold 106. The normal flow region 216 is near the turbine inlet port 218 and the turbocharger interface 202 is fixed to the turbocharger 116.

Figure 3:
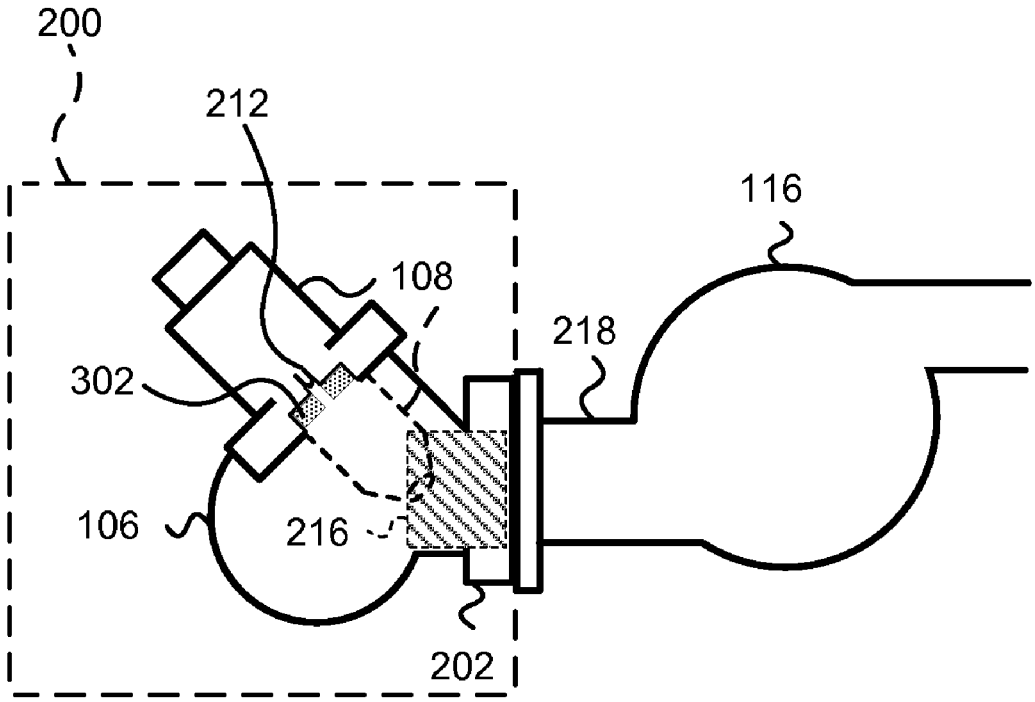
FIG. 3 is an illustration depicting one embodiment of an apparatus to enhance aftertreatment regeneration including an insulator ring in accordance with the present invention.

FIG. 3 is an illustration depicting one embodiment of an apparatus to enhance aftertreatment regeneration including an insulator ring 302 in accordance with the present invention. In the embodiment of FIG. 3, the fuel injector 212 is recessed from the residence chamber 220. The use of the flow dampener 206 can reduce the steady-state temperature of the fuel injector 212 by several hundred degrees F. The use of the insulator ring 302 can further reduce the steady-state temperature of the fuel injector 212 by tens of degrees F (e.g. 30 degrees F. for one embodiment).

Figure 4:
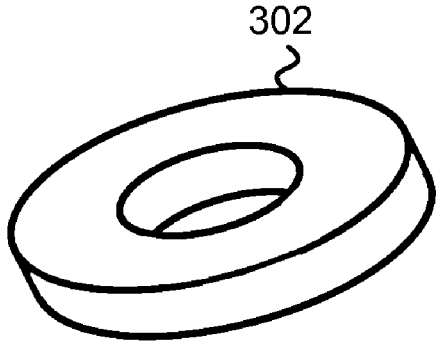
FIG. 4 is an illustration of an insulator ring in accordance with the present invention.

FIG. 4 is an illustration of an insulator ring 302 in accordance with the present invention. The thickness of the insulator ring 302 and the size of the center hole in the insulator ring 302 are limited by the geometry of the fuel injector 212. Specifically, the amount of recession of the fuel injector 212 and the spray angle of the fuel injector 212 will define the maximum thickness and/or minimum hole size of the insulator ring 302. It is a mechanical step for one of skill in the art to calculate the thickness and hole size of an insulator ring 302 based on a fuel injector 212 location relative to the residence chamber 220 and the spray angle of the fuel injector 212. The insulator ring 302 may be any material suitable for the environment of the particular system 100—preferably a material with low thermal conductivity, high temperature resistance, and easy manufacturability. In one embodiment, a ceramic fiber donut is suitable for an insulator ring 302.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus to enhance aftertreatment regeneration in an internal combustion engine system comprising an internal combustion engine in exhaust gas supplying communication with an exhaust manifold coupled to an exhaust recirculation line inlet and a turbocharger inlet, the apparatus comprising:

an extender comprising a length of hollow tube positioned within an interior of the exhaust manifold;

a flow dampener coupled to the extender, the flow dampener comprising an orifice and a sidewall that converges from the extender to the orifice, wherein the flow dampener and the orifice are disposed within the interior of the exhaust manifold, wherein the length of the hollow tube of the extender is predetermined to position the orifice within a normal exhaust flow region within the interior of the exhaust manifold adjacent the turbocharger inlet;

a residence chamber defined within the extender and the flow dampener; and a fuel injector configured to inject fuel into the residence chamber, through the orifice, and into exhaust gas within the normal exhaust flow region, wherein the residence chamber facilitates at least partial vaporization of fuel injected therein.

2. The apparatus of claim 1, wherein the extender has a length of about 40 mm, and a diameter of about 35 mm.

3. The apparatus of claim 1, wherein the orifice has a diameter of about 10 mm, and wherein a length of the flow dampener is about 20 mm.

4. The apparatus of claim 1, wherein the residence chamber has a volume of about 35,000 $mm^3$.

5. The apparatus of claim 1, wherein the fuel injector has an expected maximum fuel injection rate of about 60 $cm^3$/minute.

6. The apparatus of claim 1, wherein the extender is configured such that the injected fuel enters an exhaust stream in a location where minimal exhaust gas recycles to an engine intake.

7. The apparatus of claim 1, wherein the residence chamber has a volume such that the injected fuel experiences a sufficient residence time within the residence chamber such that the injected fuel fully vaporizes before diffusing through the orifice.

8. The apparatus of claim 1, wherein the flow dampener is configured to dampen an exhaust flow convection through the orifice into the residence chamber, such that the fuel injector maintains a temperature below a threshold temperature.

9. The apparatus of claim 8, wherein the temperature of the fuel injector is based on a size of the orifice and an angle defined between an outer surface of the extender and an outer surface of the dampener.

10. The apparatus of claim 1, wherein the extender is configured to dispose the orifice of the flow dampener within a normal flow region of the exhaust manifold.

11. The apparatus of claim 10, wherein the normal flow region comprises a region of the exhaust manifold at a location in which an exhaust flow from an engine experiences minimal flow reversal.

12. The apparatus of claim 10, wherein the normal flow region comprises a region of the exhaust manifold at a location within about three inches of a turbine inlet port.

13. The apparatus of claim 10, wherein the normal flow region comprises a region of the exhaust manifold at a location which is downstream of a plurality of cylinder exhausts from an internal combustion engine.

14. The apparatus of claim 10, wherein the residence chamber comprises a volume of at least $0.5*V_1$, wherein $V_1$ is an expected maximum fuel injection volume from the fuel injector per minute.

15. The apparatus of claim 10, wherein the residence chamber has a volume of at least 2.0 $in^3$.

16. The apparatus of claim 10, wherein the extender has a length of at least about 1.6 inches.

17. The apparatus of claim 10, further comprising an insulating ring interposed between the fuel injector and the residence chamber.

18. The apparatus of claim 1, wherein the flow dampener further comprises a wall segment, the wall segment comprising a frustum of a defining cone.

19. The apparatus of claim 18, wherein the defining cone has an angle of not more than 30 degrees.

20. The apparatus of claim 18, wherein the defining cone has an angle of not more than 45 degrees.

21. The apparatus of claim 18, wherein the extender comprises a portion of the wall segment.

22. A system to enhance aftertreatment regeneration of an exhaust aftertreatment system configured to treat an exhaust gas stream produced by an internal combustion engine, the system comprising:

an exhaust manifold comprising a first inlet, a first outlet, and a second outlet, the first inlet being communicable in exhaust gas receiving communication with an internal combustion engine, the first outlet being communicable in exhaust gas providing communication with an exhaust gas recirculation line, and the second outlet being communicable in exhaust gas providing communication with an inlet of a turbocharger, the exhaust manifold defining a cavity through which exhaust gas is flowable;

a doser assembly positioned within the cavity of the exhaust manifold, the doser assembly comprising an extender portion coupled to a flow dampener portion, the flow dampener portion comprising an orifice, wherein the extender has a length configured to dispose the orifice within a normal flow region of the cavity of the exhaust manifold in which exhaust gas flowing through the cavity experiences normal flow, the normal flow region being located immediately between the orifice of the flow dampener portion and the second outlet of the exhaust manifold, and a residence chamber defined within the extender portion and the flow dampener portion; and a fuel injector configured to inject fuel into the residence chamber, wherein fuel in the residence chamber is positioned within the normal flow region upon exiting the residence chamber through the orifice.

23. The system of claim 22, further comprising a turbocharger including a turbine inlet port, the turbine inlet port receiving the exhaust stream from the exhaust manifold, wherein the normal flow region comprises a region of the exhaust manifold at a location within about three inches of a turbine inlet port.

24. The system of claim 22, wherein the residence chamber comprises a volume of at least $0.5*V_1$, wherein $V_1$ is an expected maximum fuel injection volume from the fuel injector per minute.

25. The system of claim 22, wherein the residence chamber has a volume of at least 2.0 $in^3$.

26. The system of claim 22, wherein the extender has a length of at least about 1.6 inches.

27. The system of claim 22, wherein a displacement volume ($V_{eng}$) of the engine and a volume of the residence chamber ($V_{rc}$) have a ratio $V_{eng}/V_{rc}$ of less than about 200.

28. The system of claim 22, further comprising an insulating ring interposed between the fuel injector and the residence chamber.

29. The system of claim 22, wherein the flow dampener further comprises a wall segment, the wall segment comprising a frustum of a defining cone.

30. The system of claim 29, wherein the defining cone has an angle of not more than 30 degrees.

* * * * *